US008137098B2

(12) United States Patent
Antxia Uribetxebarria et al.

(10) Patent No.: US 8,137,098 B2
(45) Date of Patent: Mar. 20, 2012

(54) MULTIPLE GAS PILOT BURNER

(75) Inventors: José Joaquín Antxia Uribetxebarria, Aretxabaleta (ES); Ruben Mateos Martin, Marietta, GA (US)

(73) Assignee: Coprecitec, S.L., Aretxabaleta (ES)

( * ) Notice: Subject to any disclaimer, the term of this patent is extended or adjusted under 35 U.S.C. 154(b) by 458 days.

(21) Appl. No.: 12/464,626

(22) Filed: May 12, 2009

(65) Prior Publication Data

US 2009/0280448 A1 Nov. 12, 2009

(30) Foreign Application Priority Data

May 12, 2008 (ES) ..... 200800992 U

(51) Int. Cl.
*F23Q 9/00* (2006.01)

(52) U.S. Cl. ..... 431/285; 431/278; 285/131.1; 285/30

(58) Field of Classification Search ..... 431/278, 431/285; 285/30, 131.1, 132.1
See application file for complete search history.

(56) References Cited

U.S. PATENT DOCUMENTS

| | | | | | |
|---|---|---|---|---|---|
| 1,711,982 | A | * | 5/1929 | Argo et al. | 431/354 |
| 2,505,303 | A | * | 4/1950 | Randa | 285/148.13 |
| 2,582,582 | A | * | 1/1952 | Bottom | 431/283 |
| 2,661,157 | A | * | 12/1953 | Reichelderfer | 236/91 R |
| 2,677,418 | A | * | 5/1954 | Wittmann | 431/58 |
| 2,750,997 | A | * | 6/1956 | Reuter | 431/284 |
| 2,876,000 | A | * | 3/1959 | Hanley | 266/125 |
| 3,159,203 | A | * | 12/1964 | Zulian | 431/59 |
| 3,198,239 | A | * | 8/1965 | Webster | 431/278 |
| 3,319,650 | A | * | 5/1967 | Peterson | 137/561 R |
| 3,763,262 | A | * | 10/1973 | Sato et al. | 585/650 |
| 3,768,964 | A | * | 10/1973 | Smith | 432/222 |
| 3,829,279 | A | * | 8/1974 | Qualley et al. | 431/354 |
| 3,947,231 | A | * | 3/1976 | Smith | 431/285 |
| 4,044,077 | A | * | 8/1977 | Gupta | 261/23.2 |
| 4,082,325 | A | * | 4/1978 | Laundy | 285/131.1 |
| 4,315,729 | A | * | 2/1982 | Tanaka et al. | 431/75 |
| 4,798,190 | A | * | 1/1989 | Vaznaian et al. | 123/531 |
| 4,827,888 | A | * | 5/1989 | Vaznaian et al. | 123/531 |
| 5,503,550 | A | | 4/1996 | DePalma | |
| 5,575,274 | A | | 11/1996 | DePalma | |
| 5,674,065 | A | | 10/1997 | Grando et al. | |

(Continued)

FOREIGN PATENT DOCUMENTS

ES U200800992 7/2008

(Continued)

*Primary Examiner* — Kenneth Rinehart
*Assistant Examiner* — Jorge Pereiro
(74) *Attorney, Agent, or Firm* — Tim L. Kitchen; Peter B. Scull; Berenbaum Weinshienk PC

(57) ABSTRACT

A multiple gas pilot burner assembly for a household heating appliance. The pilot burner includes an injector having a first conduit for receiving a flow of a first combustible fluid, a second conduit for receiving a flow of a second combustible fluid and a third conduit connected to and in fluid communication with the first and second conduits which is configured to receive the flow of the first combustible fluid from the first conduit or the flow of the second combustible fluid from the second conduit. A single nozzle at the outlet of the third conduit is provided for supplying a pilot flame. The assembly also includes a single flame igniter positioned to cause an ignition of the pilot flame at the nozzle and also a single thermocouple positioned to be heated by the pilot flame and to generate an electrical current when heated.

3 Claims, 4 Drawing Sheets

U.S. PATENT DOCUMENTS

| | | | | |
|---|---|---|---|---|
| 5,699,776 | A * | 12/1997 | Wood et al. | 123/531 |
| 5,807,098 | A | 9/1998 | Deng | |
| 5,890,476 | A * | 4/1999 | Grant | 123/585 |
| 6,027,146 | A * | 2/2000 | Kurimoto | 285/131.1 |
| 6,045,353 | A * | 4/2000 | VonDrasek et al. | 431/79 |
| 6,116,225 | A * | 9/2000 | Thomas et al. | 123/590 |
| 6,164,702 | A * | 12/2000 | Hauber et al. | 285/21.2 |
| 6,192,913 | B1 | 2/2001 | Willey et al. | |
| 6,244,857 | B1 * | 6/2001 | VonDrasek et al. | 431/79 |
| 6,260,546 | B1 * | 7/2001 | Vaughn | 123/585 |
| 6,520,165 | B1 * | 2/2003 | Steele | 123/590 |
| 6,609,499 | B2 * | 8/2003 | Kabat et al. | 123/432 |
| 7,147,173 | B2 * | 12/2006 | Patrick | 239/426 |
| 7,434,447 | B2 | 10/2008 | Deng | |
| 2002/0160325 | A1 | 10/2002 | Deng | |
| 2002/0160326 | A1 | 10/2002 | Deng | |
| 2003/0084877 | A1 * | 5/2003 | Kabat et al. | 123/432 |
| 2004/0096790 | A1 | 5/2004 | Querejeta et al. | |
| 2007/0224558 | A1 | 9/2007 | Flick et al. | |
| 2007/0277803 | A1 | 12/2007 | Deng | |
| 2007/0277812 | A1 | 12/2007 | Deng | |
| 2007/0277813 | A1 | 12/2007 | Deng | |
| 2008/0227045 | A1 * | 9/2008 | Deng | 431/354 |

FOREIGN PATENT DOCUMENTS

| | | | |
|---|---|---|---|
| GB | 2319106 | A | 5/1998 |
| GB | 2330438 | A | 4/1999 |
| WO | WO0050815 | A1 | 8/2000 |

* cited by examiner

MULTIPLE GAS PILOT BURNER

CROSS-REFERENCE TO RELATED APPLICATIONS

This application claims priority to Spanish Patent Application No. U200800992, filed May 12, 2008.

TECHNICAL FIELD

The present invention relates to a pilot burner with adapted to multiple or dual household heating appliances that may be supplied with natural gas (NG) or liquefied petroleum gas (LPG), such as stoves or water heaters, preferably non-ventilated.

BACKGROUND

There are known household heating appliances in the prior art that include pilot burners with oxygen depletion sensors. The level of oxygen in a typical ventilated room is generally around 21%, which allows the combustion of a combustible fluid to take place correctly. Problems arise when the level of oxygen falls below 18%, a situation that may occur in non-ventilated household heating appliances and which leads to poor combustion of the combustible fluid, carbon monoxide thus being generated and causing a corresponding danger to the user. To prevent the problem, pilot burners include oxygen depletion sensors that block the passage of combustible fluid to the burners when the level of oxygen detected falls below 18%.

Known single gas pilot burners with oxygen depletion sensors generally comprise a safety thermocouple that generates an electrical current when heated by a pilot flame, the electrical current acting on a control valve to keep it open and, therefore, the passage of combustible fluid to the burners of a heating appliance, a spark generator that causes the ignition of the combustible fluid, an injector that comprises a mixing chamber where air is mixed with the combustible fluid, and a nozzle through which the injector supplies the pilot flame that heats the safety thermocouple, the safety thermocouple, the spark generator and the injector typically being fixed on a support to the interior of the heating appliance.

There are also known dual gas heating appliances in the prior art (i.e., heating appliances that may be supplied by two different combustible fluids), the combustible fluids preferably being natural and propane gas, and which include a pilot burner with oxygen depletion sensor for each combustible fluid, with the result that two each of most of the necessary components are required United States patent application published as US2007/0266765 A1 discloses a dual heating appliance that incorporates a single pilot burner for both combustible fluids, the pilot burner comprising a safety thermocouple, a spark generator, a first injector that is supplied with a first combustible fluid, and a second injector that is supplied with a second combustible fluid, the safety thermocouple, the spark generator and the first and second injectors being supported on a single support. The first injector and the second injector are disposed at an angle in relation to the safety thermocouple and facing each other, with the result that a first pilot flame supplied by the first injector heats one face of the safety thermocouple, while a second pilot flame supplied by the second injector heats the other face of the safety thermocouple.

SUMMARY OF THE DISCLOSURE

The object of the invention is to provide a pilot burner adapted to multiple or dual household heating appliances, such as stoves and water heaters, that may be supplied with multiple combustible fluids such as a first combustible fluid or with a second combustible fluid as described herein and recited in the appended claims.

In one embodiment, the pilot burner comprises a safety thermocouple, an igniter (e.g., spark generator), and an injector that includes a nozzle through which it supplies a pilot flame, the pilot flame heating the thermocouple.

In an embodiment, the injector comprises a combustion body that is connected to a first supply pipe for the first combustible fluid, to a second supply pipe for the second combustible fluid, and to the nozzle. A compact pilot burner is thus obtained, which, with a single injector, a single igniter (e.g., spark generator) and a single thermocouple, may be supplied by two different types of combustible fluid according to requirements, thereby avoiding the need to use a pilot burner for each type of combustible fluid. This thus reduces the space required in the interior of the heating appliance for the pilot burner, optimises the dimensions of the pilot burner, and reduces costs as fewer elements are used.

These and other advantages and characteristics of the invention will be made evident in the light of the drawings and the detailed description thereof.

DETAILED DESCRIPTION

Figure 1:
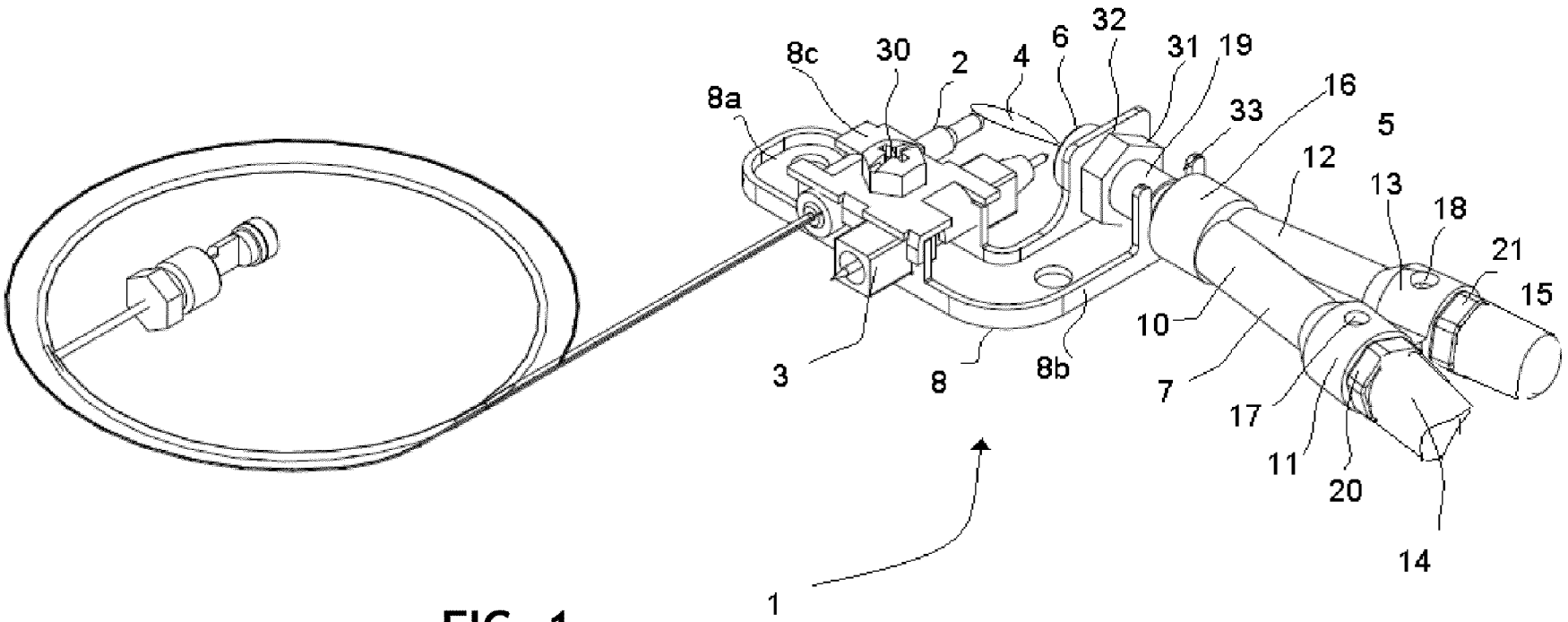
FIG. 1 is a three-dimensional view of a pilot burner according to an embodiment of the present invention.
Figure 2:
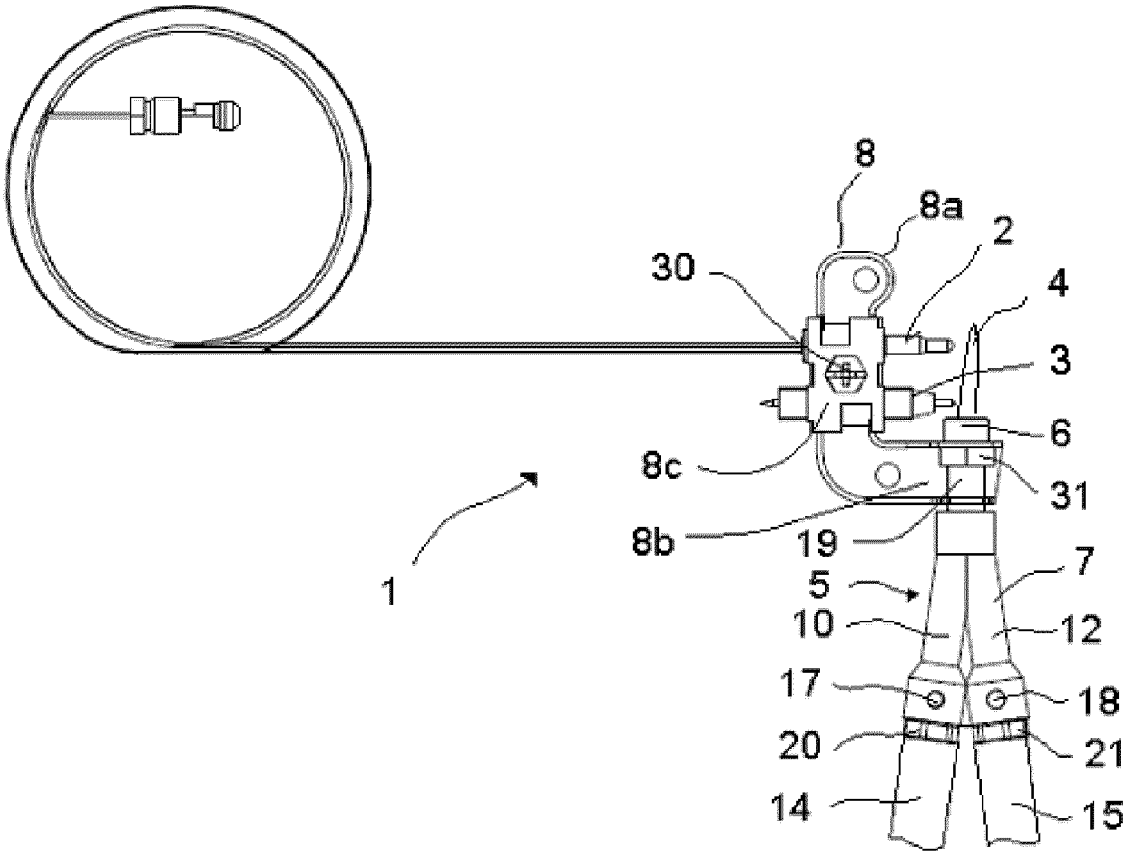
FIG. 2 is a front view of the pilot burner of FIG. 1.
Figure 3:
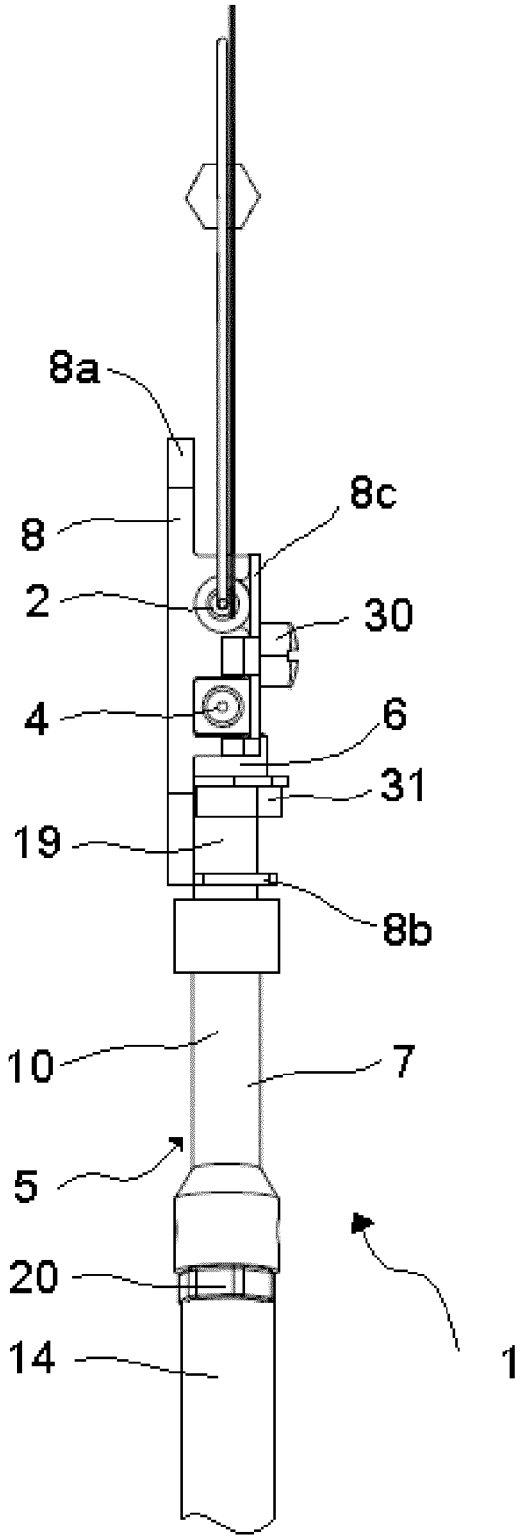
FIG. 3 is a top view of the pilot burner of FIG. 1.

With reference to FIGS. 1 to 3, a pilot burner 1 adapted to household heating appliances, such as stoves and water heaters, is shown that comprises a safety thermocouple 2 that is connected to a control valve not shown in the figures, an igniter 3 (e.g., spark generator) that is connected to an ignition switch not shown in the figures, and an injector 5 that is supplied with a first combustible fluid or a second combustible fluid and which includes a nozzle 6 through which it supplies a pilot flame 4 that heats the thermocouple 2, with the result that the thermocouple 2 continues to power the control valve to keep it open and therefore keep the passage of the first combustible fluid or the second combustible fluid to the injector 5 open.

Figure 4:
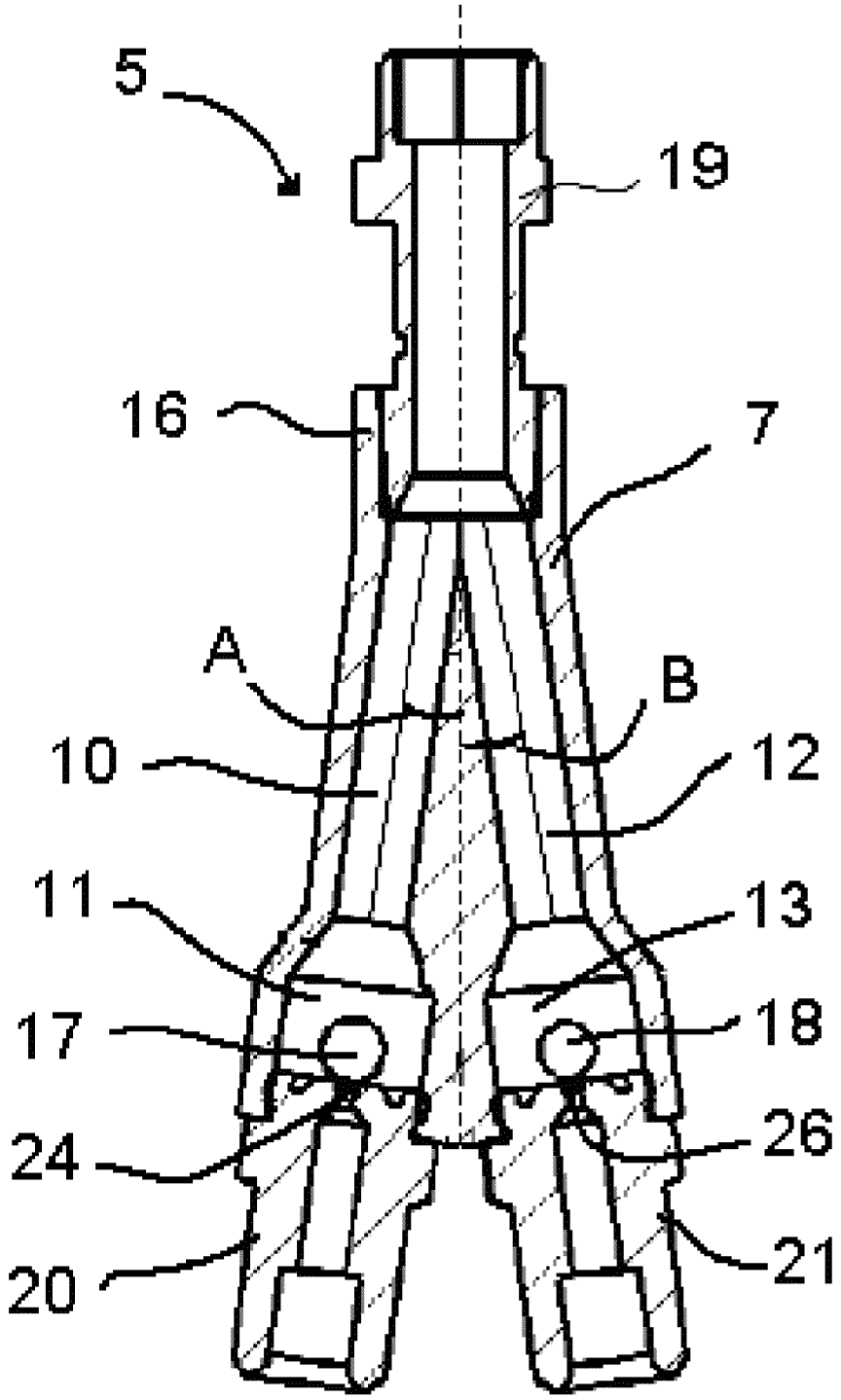
FIG. 4 is a cross-sectional view of an injector of the pilot burner of FIG. 1.

In one embodiment, the injector 5, shown in detail in FIG. 4, comprises a combustion body 7 preferably made of injected aluminium, which is connected by means of a first connector 20 to a first supply pipe 14 that supplies the first combustible fluid, the first combustible fluid preferably being natural gas, and by means of a second connector 21 to a second supply pipe 15 that supplies the second combustible fluid, the second combustible fluid preferably being propane, and a combustion pipe 19 that connects the combustion body 7 to the nozzle 6. The first supply pipe 14 and the second supply pipe 15 are connected to a selector valve not shown in the figures, which selects the type of combustible fluid, the first combustible fluid or second combustible fluid, to be supplied to the injector 5.

The pilot burner 1 comprises an L-shaped support 8, which may be fixed in the interior of the heating appliance, and which includes a first segment 8*a* with a substantially U-shaped section, upon which the igniter 3 and the thermocouple 2 are fixed by means of a bracket 8c, the bracket 8*c* being fixed to the first segment 8*a* by means of a screw 30, and a second segment 8*b* with a substantially U-shaped section, onto which the injector 5 is fixed. The second segment 8*b* includes, on one of the branches of the U, a hole 32 through which the injector 5 passes, the injector 5 being fixed to the branch by means of a nut 31, and, on the other branch, a wide hole 33 into which the combustion pipe 19 of the injector 5 is tightly fitted through an external perimeter groove 29 included in the combustion pipe 19, thereby preventing the injector 5 from rotating in relation to the support 8.

In one embodiment, the thermocouple 2 and the igniter 3 are disposed parallel to each other, while the injector 5 is disposed substantially orthogonally to the thermocouple 2 and the igniter 3.

In addition, the combustion body 7, shown in detail in FIG. 4, comprises a substantially cylindrical connection chamber 16 in which it is connected to the combustion pipe 19, a substantially cylindrical first mixing chamber 11 that is connected to the connection chamber 16 by means of a first combustion pipe 10, and a second substantially cylindrical mixing chamber 13 that is connected to the connection chamber 16 by means of a second combustion pipe 12, the first mixing chamber 11 being supplied with the first combustible fluid through the first supply pipe 14, and the second mixing chamber 13 with the second combustible fluid through the second supply pipe 15.

The first combustion pipe 10 is preferably disposed concentrically and continuously to the first mixing chamber 11, the central or axial axis of the first combustion pipe 10 forming a first angle A in relation to the central or axial axis of the connection chamber 16, and the second combustion pipe 12 is preferably disposed concentrically and continuously to the second mixing chamber 13, the central or axial axis of the second combustion pipe 12 forming a second angle B in relation to the central or axial axis of the connection chamber 16. In the embodiment shown in the figures, the first angle A and the second angle B are equal and of a maximum value of 10°, thereby minimising the load loss of the combustible fluid as it passes through the connection chamber 16.

Furthermore, the first connector 20 and the second connector 21, shown in detail in FIG. 4, are preferably made of brass and have a substantially cylindrical and hollow shape, a first element that includes a first calibrated hole 24 provided within the interior of the first connector 20 through which the first combustible fluid enters, and a second element that includes a second calibrated hole 26 provided within the interior of the second connector through which the second combustible fluid enters, the first element and second element preferably made of a hard material, preferably ruby.

The first mixing chamber 11 includes, on a side wall, a first hole 17 or first holes 17 that are preferably disposed diametrically opposite to each other and through which air enters, thus causing in the first mixing chamber 11 a first mixing of air/combustible fluid (e.g., air/natural gas), while the second mixing chamber 13 includes, on a side wall, a second hole 18 or second holes 18 that are preferably disposed diametrically opposite to each other and through which air enters, thus causing in the second mixing chamber 11 a second mixing of air/combustible fluid (e.g., air/propane), the diameters of the first hole 17 and the second hole 18 being defined, as well as the first calibrated hole 24 and the second calibrated hole 26, in accordance with the type of combustible fluid, natural gas or propane, that passes through the first mixing chamber 11 and the second mixing chamber 12 respectively.

In the embodiment shown in FIGS. 1 to 4, the first mixing chamber 11 has a cross-section with a diameter similar to that of the cross-section of the second mixing chamber 13. The first combustion pipe 10 also has a cross-section with a diameter similar to the second combustion pipe 12.

When the pilot burner 1 is operating normally (i.e., when the ambient oxygen levels are above 20%), the combustion of the corresponding combustible fluid takes place correctly, and the pilot flame 4 is of such a length that it heats the safety thermocouple 2, with the result that the thermocouple 2 generates a current that powers the control valve. The current generating a magnetic field within the control valve to keep the control valve open and, therefore, the passage of combustible fluid to the injector 5 of the pilot burner 1, and to injectors, not shown in the figures, in the main heaters of the heating appliance.

In the event that the levels of ambient oxygen are below 20%, the combustion of the corresponding combustible fluid does not take place correctly. As there is not a sufficient supply of oxygen to maintain the stoichiometric proportion of the mixture to ensure correct combustion, the pilot flame 4 begins to burn more quickly in an effort to absorb more air, the flame shortening before eventually going out. In such a situation the thermocouple 2 cools down and does not generate the necessary current to power the control valve to keep it open, as a result of which the control valve blocks the passage of combustible fluid to the pilot burner 1 and to the main burners. The first air intake hole or holes 17 and the second air intake hole or holes 18 are of such a size that when the level of oxygen in the enclosure falls below the stipulated safety limits, preferably at or below 20%, the burner switches off regardless of the type of gas being used.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A multiple gas pilot burner for a household heating appliance comprising:

an injector having a first conduit for receiving a flow of a first combustible fluid, a second conduit for receiving a flow of a second combustible fluid, a third conduit connected to and in fluid communication with the first conduit and second conduit and configured to receive the flow of the first combustible fluid from the first conduit or the flow of the second combustible fluid from the second conduit, a single nozzle at an outlet of the third conduit for supplying a pilot flame, a first mixing chamber in fluid communication with the first conduit, and a second mixing chamber in fluid communication with the second conduit, the first, second and third conduits each having a central axis, the central axis of the first conduit forming a first angle in relation to the central axis of the third conduit, the central axis of the second conduit forming a second angle in relation to the central axis of the third conduit, the first angle and the second angle each having a maximum value of 10 degrees, a single flame igniter positioned to cause an ignition of the pilot flame at the single nozzle; and a single thermocouple positioned to be heated by the pilot flame and to generate an electrical current when heated, wherein the first mixing chamber has one or more first air intake holes and the second mixing chamber has one or more second air intake holes, the first air intake hole or holes and second air intake hole or holes being sized to prevent combustion of the first combustible fluid and second combustible fluid at the single nozzle when the ambient oxygen level falls below a specific level.

2. A multiple gas pilot burner according to claim 1, wherein the first mixing chamber and the second mixing chamber have a similar internal cross-sectional area.

3. A multiple gas pilot burner for a household heating appliance comprising:

an injector having a first conduit for receiving a flow of a first combustible fluid, a second conduit for receiving a flow of a second combustible fluid, a third conduit connected to and in fluid communication with the first conduit and second conduits and configured to receive the flow of the first combustible fluid from the first conduit or the flow of the second combustible fluid from the second conduit, a single nozzle at an outlet of the third conduit for supplying a pilot flame, a first mixing chamber in fluid communication with the first conduit and a second mixing chamber in fluid communication with the second conduit, a single flame igniter positioned to cause an ignition of the pilot flame at the single nozzle; and a single thermocouple positioned to be heated by the pilot flame and to generate an electrical current when heated, wherein the first conduit, second conduit and third conduit each have a central axis, the central axis of the first conduit forming a first angle in relation to the central axis of the third conduit, the central axis of the second conduit forming a second angle in relation to the central axis of the third conduit, the first angle and the second angle each having a maximum value of 10 degrees, and wherein the first mixing chamber has one or more first air intake holes and the second mixing chamber has one or more second air intake holes, the first combustible fluid delivered to the first mixing chamber through a first calibrated hole, the second combustible fluid delivered to the second mixing chamber through a second calibrated hole, the first air intake holes and second air intake hole and the first calibrated hole and second calibrated holes being sized to prevent a combustion of the first and second combustible fluids at the nozzle when the ambient oxygen level falls below a specific level.

* * * * *